US011717885B2

(12) United States Patent
Nishida et al.

(10) Patent No.: US 11,717,885 B2
(45) Date of Patent: Aug. 8, 2023

(54) CASTING FACILITY CONTROL SYSTEM

(71) Applicants: SINTOKOGIO, LTD., Nagoya (JP); Fujiwa Denki Co., Ltd., Aichi (JP)

(72) Inventors: Tadashi Nishida, Aichi (JP); Toshiyuki Hyodo, Aichi (JP); Masanori Hoshino, Aichi (JP)

(73) Assignees: SINTOKOGIO, LTD., Nagoya (JP); Fujiwa Denki Co., Ltd., Aichi (JP)

( * ) Notice: Subject to any disclaimer, the term of this patent is extended or adjusted under 35 U.S.C. 154(b) by 0 days.

(21) Appl. No.: 17/893,428

(22) Filed: Aug. 23, 2022

(65) Prior Publication Data

US 2023/0062786 A1 Mar. 2, 2023

(30) Foreign Application Priority Data

Aug. 27, 2021 (JP) ..... 2021-139181

(51) Int. Cl.
*B22D 37/00* (2006.01)

(52) U.S. Cl.
CPC ..... *B22D 37/00* (2013.01)

(58) Field of Classification Search
CPC ..... B22C 37/00; B22C 25/00; B22D 46/00
See application file for complete search history.

(56) References Cited

U.S. PATENT DOCUMENTS

2012/0232688 A1* 9/2012 Adachi ..... B22D 47/02 700/146

FOREIGN PATENT DOCUMENTS

JP 6472899 B2 2/2019
WO WO-2017/085765 A1 5/2017

* cited by examiner

*Primary Examiner* — Kevin P Kerns
*Assistant Examiner* — Steven S Ha
(74) *Attorney, Agent, or Firm* — Faegre Drinker Biddle & Reath LLP

(57) ABSTRACT

A casting facility control system includes: a database storing conveyance positions and mold information in association with each other; an update section updating the mold information associated with each conveyance position stored in the database; a measurement section measuring a weight of molten metal in a ladle transported to a pouring machine; a calculation section calculating the number of flasks by which the molten metal poured from the ladle can be held; a decision section recognizing, based on the number of flasks by which the poured molten metal can be held, a plurality of molds into which the molten metal to be next transported to the pouring machine is poured, adding up the planned weight of molten metal corresponding to each of the recognized molds, and determining a predicted weight of molten metal to be next transported to the pouring machine; and an output section outputting the predicted weight.

20 Claims, 9 Drawing Sheets

*Fig.3*

| PLANNED MOLD SERIAL NUMBER | BASIC SHIFT INFORMATION | |
|---|---|---|
| | MOLDING PATTERN NUMBER | PLANNED CASTING WEIGHT |
| 1 | 1235 | 75Kg |
| 2 | 1235 | 75Kg |
| 3 | 1235 | 75Kg |
| 4 | 1235 | 75Kg |
| 5 | 1235 | 75Kg |
| 6 | 1235 | 75Kg |
| 7 | 1235 | 75Kg |
| 8 | 1235 | 75Kg |
| 9 | 1235 | 75Kg |
| 10 | 1235 | 75Kg |
| 11 | 1235 | 75Kg |
| 12 | 1235 | 75Kg |
| 13 | 1235 | 75Kg |
| 14 | 1235 | 75Kg |
| 15 | 1234 | 50Kg |
| 16 | 1234 | 50Kg |
| 17 | 1234 | 50Kg |
| 18 | 1234 | 50Kg |
| • | 1234 | 50Kg |
| • | 1234 | 50Kg |

*Fig.4A*

| | |
|---|---|
| MOLDING PATTERN NUMBER DATABASE | PLANNED CASTING WEIGHT |
| | PLANNED MATERIAL QUALITY NUMBER |
| | PLANNED POURING PATTERN NUMBER |
| | PLANNED POURING TEMPERATURE |

*Fig.4B*

| | |
|---|---|
| LADLE SERIAL NUMBER DATABASE | MATERIAL QUALITY NUMBER |
| | ALLOY CHARGE INFORMATION |
| | MOLTEN METAL RECEPTION INFORMATION<br>・TIME PASSING AFTER MOLTEN METAL IS RECEIVED<br>・WEIGHT OF MOLTEN METAL RECEIVED<br>・TEMPERATURE OF MOLTEN METAL RECEIVED |
| | SECONDARY INOCULATION INFORMATION |
| | FADING START TIME |
| | TEST PIECE SERIAL NUMBER |

CASTING FACILITY CONTROL SYSTEM

CROSS-REFERENCE TO RELATED APPLICATION

This application is based on Japanese Patent Application No. 2021-139181 filed with Japan Patent Office on Aug. 27, 2021, the entire contents of which are hereby incorporated by reference.

TECHNICAL FIELD

The present disclosure relates to a casting facility control system.

BACKGROUND

Japanese Patent No. 6472899 discloses casting facility. In the casting facility, a ladle receives molten metal at a melting furnace and is transported to a pouring machine. A plurality of molds is molded by a molding machine and are conveyed to the pouring machine one by one. At the pouring machine, the molten metal in the ladle is poured into the plurality of molds. The pouring machine receives a ladle serial number associated with molten metal state data on the molten metal in the ladle, receives a mold serial number of a mold positioned at a pouring position, and is controlled so as to pour the molten metal based on a pouring plan corresponding to pouring plan data corresponding to the mold serial number. The ladle serial number of the ladle that has poured the molten metal is associated with the mold serial number.

SUMMARY

In the casting facility as disclosed in Japanese Patent No. 6472899, it is necessary to achieve carbon neutrality as a measure against global warming $CO_2$ reduction must be realized throughout the industry. It is necessary for the manufacturing industry to concretize the low carbon countermeasure from the viewpoint of energy saving. In the pouring process of casting, molten metal is poured into a pouring ladle at a melting site, and the pouring ladle is conveyed to the pouring site by a molten metal conveying device or the like, and poured by a pouring machine. However, when molten metal is poured into the pouring ladle at the melting site, the weight of molten metal required by the pouring machine or the material of the product does not match, so that the molten metal may have to be returned to the melting site or the molten metal may be wasted at the melting site. Further, in a casting facility as described in Japanese Patent No. 6472899, a plurality of devices is involved in molding a mold. It is necessary to strengthen the cooperation between each device in order to realize a casting facility in which molten metal with the same composition and viscosity as planned is poured into a mold with a stable momentum. The present disclosure provides a technique for coordinating a molding plan and a melting plan.

A casting facility control system according to one aspect of the present disclosure controls a casting facility. The casting facility includes a molding machine, a mold conveyance device, a melting furnace, a ladle transportation device, and a pouring machine. The molding machine molds a plurality of molds. The mold conveyance device arranges in a line and conveys the plurality of molds molded by the molding machine. The melting furnace melts material to be melted. The ladle transportation device transports a ladle. The pouring machine pours molten metal in the ladle transported by the ladle transportation device into the plurality of molds conveyed by the mold conveyance device. The casting facility control system includes a database, an update section, a measurement section, a calculation section, a decision section, and an output section. The database stores a plurality of conveyance positions fixedly assigned to the line of molds, and mold information corresponding to a mold positioned at each of the conveyance positions in association with each other. The update section updates the mold information associated with each of the conveyance positions stored in the database, in response to flask feeding by the mold conveyance device. The measurement section measures a weight of the molten metal in the ladle transported to the pouring machine by the ladle transportation device. The calculation section calculates the number of flasks by which the molten metal poured from the ladle transported to the pouring machine can be held, based on the weight of the molten metal measured by the measurement section and on a planned weight of molten metal included in the mold information associated with each of the conveyance positions stored in the database. The decision section determines a predicted weight of molten metal to be next transported to the pouring machine, by recognizing, based on the number of flasks by which the poured molten metal can be held calculated by the calculation section, the plurality of molds into which the molten metal to be next transported to the pouring machine is poured, and adding up the planned weight of molten metal corresponding to each of the recognized molds. The output section outputs the predicted weight determined by the decision section, as fabrication instruction data on the melting furnace.

In the casting facility control system, the weight of the molten metal in the ladle transported to the pouring machine is measured, and the number of flasks by which the molten metal poured from the ladle transported to the pouring machine can be held is calculated based on the measured weight of the molten metal and the planned weight of molten metal included in the mold information associated with each of the conveyance positions stored in the database. Then, the plurality of molds into which the molten metal to be next transported to the pouring machine is poured is recognized based on the calculated number of flasks that can hold the poured molten metal. The planned weight of molten metal corresponding to each of the recognized molds is added up, and the predicted weight of the molten metal to be next transported to the pouring machine is determined. The predicted weight determined by the decision section is outputted as the fabrication instruction data on the melting furnace. In such a manner, the casting facility control system can determine the predicted weight of the next molten metal, based on the planned weights of molten metal, and can reflect the predicted weight in the fabrication instruction data on the melting furnace. Accordingly, the casting facility control system can coordinate the molding plan and the melting plan. In addition, the casting facility control system can determine the optimum amount of molten metal to be received by matching the molding plan and the melting plan. In the casting facility control system, the optimum amount of molten metal to be received by the pouring ladle is instructed to the melting site, so that the weight of molten metal to be received can be prevented from being excessive or insufficient, and waste molten metal and molten metal return can be eliminated to save energy. Therefore, the casting facility control system can be expected to reduce $CO_2$ emissions and contribute to carbon neutrality.

In one embodiment, the mold information may further include a planned temperature of molten metal to be poured into a corresponding mold, the decision section may determine a temperature of the molten metal to be next transported to the pouring machine, based on the planned temperature of molten metal for each of the recognized molds, and the output section may output the temperature determined by the decision section, as the fabrication instruction data. In such a case, the casting facility control system can determine the temperature of the molten metal to be next transported, based on the planned temperatures corresponding to the plurality of molds into which the molten metal to be next transported is poured, and can reflect the temperature of the molten metal to be next transported in the fabrication instruction data on the melting furnace. Accordingly, the casting facility control system can coordinate the molding plan and the melting plan.

In one embodiment, the mold information may further include planned material quality information on molten metal to be poured into a corresponding mold, the decision section may determine material quality information on the molten metal to be next transported to the pouring machine, based on the planned material quality information on molten metal for each of the recognized molds, and the output section may output the material quality information determined by the decision section, as the fabrication instruction data. In such a case, the casting facility control system can determine the material quality information on the molten metal to be next transported, based on the planned material quality information corresponding to the plurality of molds into which the molten metal to be next transported is poured, and can reflect the material quality information on the molten metal to be next transported in the fabrication instruction data on the melting furnace. Accordingly, the casting facility control system can coordinate the molding plan and the melting plan.

In one embodiment, the casting facility control system may include an acquisition section acquiring actual result data on the pouring machine; and a pouring actual result database storing the actual result data acquired by the acquisition section and identification information on a ladle in association with each other. In such a case, since the actual result data can be recorded for each ladle, for example, the casting facility control system can verify whether or not the molten metal transported to the pouring machine is as planned.

In one embodiment, the actual result data may include at least one of a weight of molten metal received, a temperature of the molten metal received, a time passing after the molten metal is received, a pouring temperature, a fading start time, material quality information, and test piece identification information.

In one embodiment, the casting facility control system may include a determination section determining whether or not execution of pouring is allowed, by matching the mold information corresponding to a pouring-target mold against the actual result data. In such a case, execution of pouring is determined based on information grasped before pouring is executed, such as the weight of the molten metal received, the temperature of the molten metal received, the time passing after the molten metal is received, or the material quality information. Accordingly, pouring different from a plan can be avoided.

A casting facility control system according to another aspect of the present disclosure controls a casting facility. The casting facility includes a molding machine, a mold conveyance device, a melting furnace, a ladle transportation device, and a pouring machine. The molding machine molds a plurality of molds. The mold conveyance device arranges in a line and conveys the plurality of molds molded by the molding machine. The melting furnace melts material to be melted. The ladle transportation device transports a ladle. The pouring machine pours molten metal in the ladle transported by the ladle transportation device into the plurality of molds conveyed by the mold conveyance device. The casting facility control system includes a measurement section and a decision section. The measurement section measures a weight of the molten metal in the ladle transported to the pouring machine by the ladle transportation device. The decision section determines a weight of molten metal to be next transported to the pouring machine. Here, the weight of the molten metal to be next transported to the pouring machine is equal to a weight obtained by adding up planned weights of molten metal corresponding to the plurality of molds, the plurality of molds being determined depending on the number of flasks by which the poured molten metal can be held calculated based on the weight of the molten metal in the ladle measured by the measurement section and on a planned weight of molten metal associated with each conveyance position. The casting facility control system according to the other aspect of the present disclosure achieves the same advantageous effects as the casting facility control system according to the one aspect of the present disclosure.

According to various aspects and embodiments of the present disclosure, a molding plan and a melting plan can be coordinated.

BRIEF DESCRIPTION OF THE DRAWINGS

FIG. 3 is an example of a molding plan database;

FIG. 4A is an example of a molding pattern number database;

FIG. 4B is an example of a ladle serial number database;

DETAILED DESCRIPTION

Hereinafter, exemplary embodiments of the present disclosure are described with reference to the drawings. Note that in the following description, the same or equivalent elements are denoted by the same reference signs, and an overlapping description is not repeated.

[Outline of Casting Facility]

Figure 1:
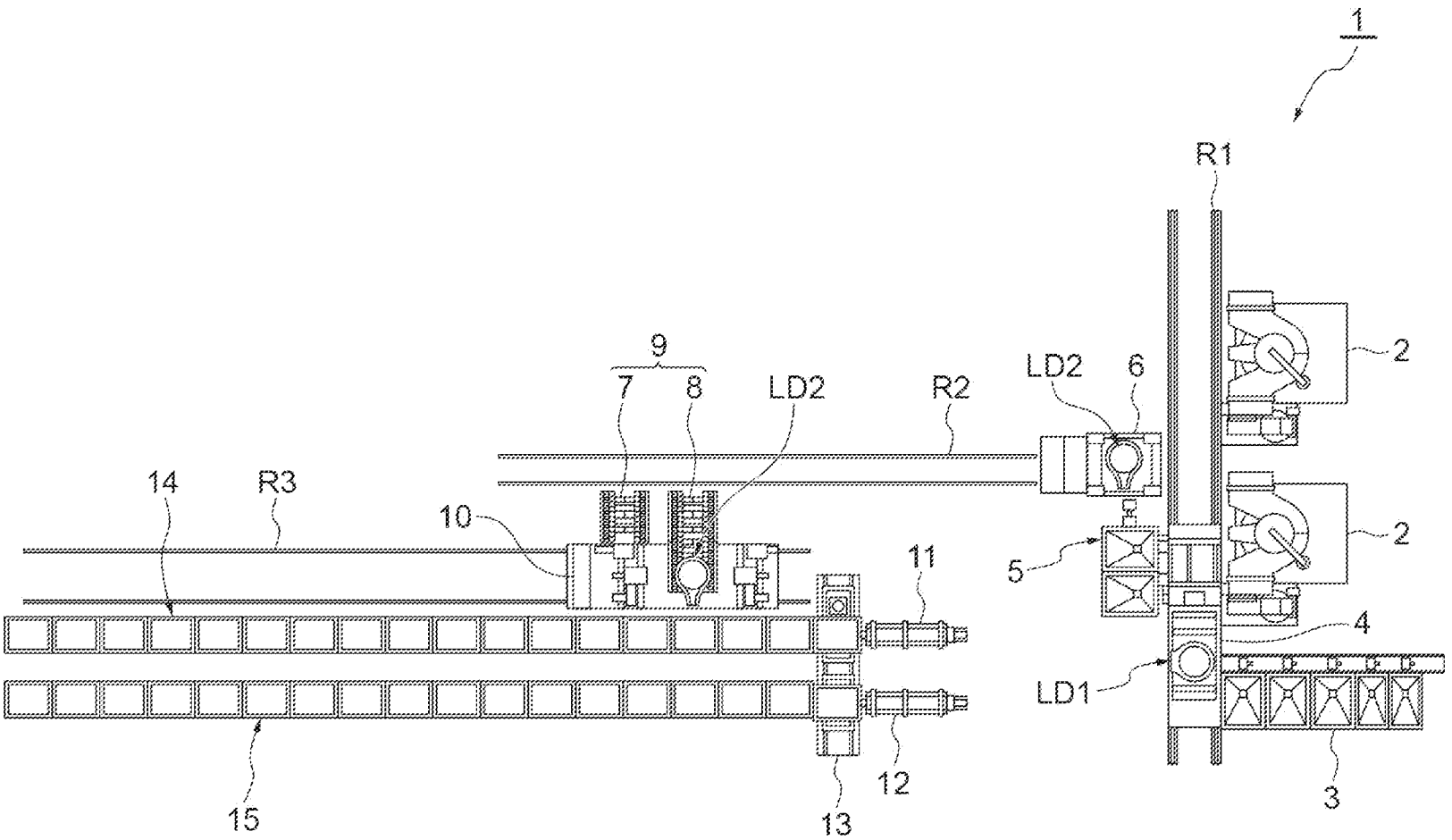
FIG. 1 is a plane view showing part of a casting facility according to an exemplary embodiment.

FIG. 1 is a plane view showing part of a casting facility according to an exemplary embodiment. The casting facility 1 shown in FIG. 1 taps part of raw molten metal obtained at a melting furnace into a ladle, transports the ladle containing the molten metal to a pouring machine, and pours the molten metal in the transported ladle into a mold by using the pouring machine.

As shown in FIG. 1, the casting facility 1 includes, as an example, a melting furnace 2, a primary inoculation device 3, a molten metal reception carriage 4 (an example of a ladle transportation device) transporting a treatment ladle LD1 along a molten metal reception carriage rail R1, a secondary inoculation device 5, a transportation carriage 6 (an example of the ladle transportation device) transporting a pouring ladle LD2 along a transportation carriage rail R2, a ladle exchange device 9, and a pouring machine 10.

The melting furnace 2 is a device melting material to be melted with heat and obtaining raw molten metal. The number of melting furnaces 2 may be one, or may be two or more. In the example in FIG. 1, two melting furnaces 2 are installed in parallel. Examples of the material to be melted include pig iron, recycled material, steel scrap, and alloy material. The melting furnace 2 is, for example, an electric furnace or a cupola, and is not particularly limited as long as the furnace can melt the material to be melted. A corresponding material-to-be-melted charge device is installed in parallel to each melting furnace 2, and the material to be melted is charged into the furnace by the material-to-be-melted charge device. Operation of the melting furnace 2 and the material-to-be-melted charge device is controlled by a melting block control device 60 (FIG. 2), which will be described later. A temperature sensor is provided to the melting furnace 2 and can acquire the temperature of the raw molten metal. The molten metal in the melting furnace 2 can be sampled for component inspection and inspected by a carbon analysis device, a quantovac element analysis device, a CE meter, and the like in a laboratory. The melting furnace 2 can obtain, at a time, as large an amount of the raw molten metal as can be tapped a plurality of times into a molten metal reception ladle, which will be described later.

The primary inoculation device 3 is a device adjusting components of the raw molten metal received in the treatment ladle LD1. The primary inoculation device 3 includes, for example, a hopper, a measurement device, a charge chute, and the like, and charges a material to be added to the raw molten metal into the treatment ladle LD1. The primary inoculation device 3 is installed in parallel to the molten metal reception carriage rail R1 for the molten metal reception carriage 4. The addition material is added to the molten metal in order to increase the strength and toughness of cast iron, or to enhance corrosion resistance, heat resistance, abrasion resistance, and the like. Examples of the addition material include Mg, Ce, Ca, Ni, Cr, Cu, Mo, V, and Ti. The addition material may contain a graphite spheroidizing agent. The primary inoculation device 3 may add an inoculant such as calcium silicide, ferro silicon, or graphite. Operation of the primary inoculation device 3 is controlled by an alloy charge control device 52 (FIG. 2), which will be described later. Note that the primary inoculation device 3 may charge the addition material through wire inoculation.

The molten metal reception carriage 4 carries the treatment ladle LD1 and transports the treatment ladle LD1 along the molten metal reception carriage rail R1. The molten metal reception carriage 4 can stop not only at a position of inoculation by the above-described primary inoculation device 3, but also at a position of molten metal reception from the melting furnace 2. The molten metal reception carriage 4 may include an emptying function. Emptying is to transfer molten metal to another ladle. The molten metal reception carriage 4 can stop at an emptying position and empty the contained molten metal into the pouring ladle LD2.

The molten metal reception carriage 4 may include a ladle tilting mechanism, a weight measurement mechanism, and a non-contact thermometer. The ladle tilting mechanism causes the treatment ladle LD1 to rotate and tilt, centered on a rotation shaft extending along the molten metal reception carriage rail R1. Thus, the molten metal can be emptied into the pouring ladle LD2 at the emptying position. The weight measurement mechanism is a mechanism including a sensor that measures the amount of raw molten metal received. The weight measurement mechanism includes, for example, a load cell and the like. The non-contact thermometer is a sensor measuring the temperature of raw molten metal in a non-contact manner. The molten metal reception carriage 4 may measure the rotation of a wheel, that is, traveling, by including an encoder on the wheel. Thus, the position of the treatment ladle LD1 is detected. The molten metal reception carriage 4 may include another position detection sensor such as a photoelectronic sensor. Operation of the molten metal reception carriage 4 is controlled by a molten metal reception carriage control device 53 (FIG. 2), which will be described later.

The secondary inoculation device 5 is a device adjusting components of molten metal contained in the pouring ladle LD2. The secondary inoculation device 5 includes, for example, a hopper, a measurement device, a charge chute, and the like, and charges a material to be added to the molten metal into the treatment ladle LD1. The addition material is charged when the molten metal is emptied from the treatment ladle LD1 into the pouring ladle LD2, whereby the addition material can be uniformly charged in a short time. Moreover, since the weight of the molten metal can be measured on the molten metal reception carriage 4, the addition material can be charged in such a manner that the ratio between the molten metal and the material (inoculation material ratio) becomes accurate. Operation of the secondary inoculation device 5 is controlled by an alloy charge control device 52 (FIG. 2), which will be described later. Note that the secondary inoculation device 5 may be installed on the molten metal reception carriage 4. Moreover, the secondary inoculation device 5 may charge the addition material through wire inoculation.

The transportation carriage 6 carries the pouring ladle LD2 and transports the pouring ladle LD2 along the transportation carriage rail R2. In addition to the above-described emptying position, the transportation carriage 6 can also stop at a ladle exchange position from which the pouring ladle LD2 is transported to the pouring machine 10. The transportation carriage 6 may include a function capable of changing the direction of the pouring ladle LD2. The transportation carriage 6 may measure the rotation of a wheel, that is, traveling, by including an encoder on the wheel. Thus, the position of the pouring ladle LD2 is detected. The transportation carriage 6 may include another position detection sensor such as a photoelectronic sensor. Operation of the transportation carriage 6 is controlled by a transportation carriage control device 54 (FIG. 2), which will be described later.

The ladle exchange device 9 is a device installed at a stage prior to the pouring machine 10 (at the ladle exchange position), and exchanging a pouring ladle LD2 containing molten metal (full ladle) with a pouring ladle LD2 that has been emptied by pouring molten metal (empty ladle). The ladle exchange device 9 includes a roller conveyor 7 receiving the full ladle on the transportation carriage 6, and a roller conveyor 8 allowing the empty ladle to wait thereon. The pouring machine 10 slides, whereby exchange between the full ladle and the empty ladle is achieved. For example, the pouring machine 10 slides into front of the roller conveyor 8, whereby the empty ladle is passed from the pouring machine 10 to the roller conveyor 8. The full ladle is transported from the transportation carriage 6 to the roller conveyor 7. The pouring machine 10 slides into front of the roller conveyor 7, whereby the full ladle is passed from the roller conveyor 7 to the pouring machine 10.

The pouring machine 10 is a device pouring molten metal contained in the pouring ladle LD2 into a mold. The pouring machine 10 is installed on a side to a pouring zone 14. In the pouring zone 14, a mold conveyance device arranges, in a line, a plurality of molds molded by a molding machine M (FIG. 5), which will be described later, and conveys the molds one by one. In the pouring zone 14, the pouring machine 10 pours the molten metal in the pouring ladle LD2 into a mold that is being conveyed.

In the pouring zone 14, a rail for molds is laid, and a pair of mold feeding devices 11 (a pusher and a cushion) that are mold conveyance devices are disposed at both ends of the rail, respectively. The pusher included in the mold feeding devices 11 includes a function of pushing a mold out, and the cushion included in the mold feeding devices 11 includes a function of receiving the pushed-out mold. With the pusher and the cushion, molds can be tightly fed. The mold feeding devices 11 including the pusher and the cushion feed molds one by one. In FIG. 1, only the mold feeding device (cushion) at the front end of the rail is depicted, and depiction of the mold feeding device (pusher) disposed at the rear end of the rail is omitted. Each mold feeding device 11 is a device including an extendable rod and is a servo cylinder as an example. The pair of mold feeding devices 11 sandwich the line of molds on the rail in between and operate in synchronization according to a predetermined velocity curve. Specifically, the mold feeding device (pusher) disposed at the rear end of the rail pushes molds lined at the rear of the rail, flask by flask, by extending the rod and thus intermittently conveys the lined molds flask by flask. The mold feeding device (cushion) disposed at the front end of the rail operates in such a way as to contract the rod in response to a mold at the rear end being pushed by the pusher. With a configuration thus made, the line of molds can be fastened from the both ends also during conveyance. Accordingly, the molds are stabilized also during conveyance, and vibration control can also be accomplished.

When a mold reaches the front end of the rail in the pouring zone 14, the mold is transferred to an adjoining cooling zone 15 by a traverser 13. In the cooling zone, while the mold after the molten metal is poured therein is being cooled, the mold is conveyed to a mold knock-out device (not shown). In the cooling zone 15, a rail for molds is laid, and a pair of mold feeding devices 12 (a pusher and a cushion) are disposed at both ends of the rail, respectively, as in the pouring zone 14. In FIG. 1, only the mold feeding device (pusher) at the rear end of the rail is depicted, and depiction of the mold feeding device (cushion) disposed at the front end of the rail is omitted. Operation of the mold feeding devices 12 is the same as the operation of the mold feeding devices 11. Molds in the cooling zone 15 are conveyed by the mold feeding devices 12 in a direction opposite to a direction in which molds in the pouring zone 14 are conveyed. The mold after the molten metal is poured therein is cooled on the rail over time, and the molten metal is solidified and becomes a casting before the mold reaches the mold knock-out device. Each mold feeding device 11, 12 may include a mold position sensor that is a sensor detecting extension and contraction of the rod and that detects conveyance of a mold. Examples of the mold position sensor include a limit switch and a proximity switch. Conveyance of a mold is controlled by a molding line control device 30 (FIG. 2), which will be described later. When the pouring machine 10 and conveyance of a mold need to be synchronized with each other, an encoder, a length measurement sensor, or the like is disposed on the rail in the pouring zone 14. The pouring machine 10 is controlled in such a way as to be synchronized with conveyance of a mold, based on the conveyance speed and the position of the mold acquired by using the sensors.

The pouring machine 10 includes a pouring carriage that travels on a pouring rail R3 laid in parallel with the rail in the pouring zone 14, a hoisting and lowering mechanism installed on the pouring carriage, and a tilting mechanism supported by the hoisting and lowering mechanism and tilting a pouring ladle LD2 on board. The hoisting and lowering mechanism is installed on a forward and rearward movement mechanism that moves in a direction orthogonal to a direction in which the pouring carriage travels. The pouring machine 10 includes a load cell measuring the weight of the molten metal in the pouring ladle LD2, a non-contact thermometer measuring the temperature of the molten metal to be poured, and the like. Operation of the pouring machine 10 is controlled by a pouring block control device 40 (FIG. 2), which will be described later.

The pouring machine 10 may include a test piece collection unit receiving molten metal for a test piece from the pouring ladle LD2. At the test piece collection unit, a test piece is collected from molten metal in each pouring ladle LD2 in order to inspect material quality.

The molding machine M is a device molding a plurality of molds. The molding machine M molds upper and lower frames by squeezing mold sand. The molding machine M is not particularly limited as long as the molding machine M is a device that can mold upper and lower molds. Operation of the molding machine M is controlled by a molding block control device 20 (FIG. 2), which will be described later.

The casting facility 1 includes a position detection sensor (not shown) detecting that a ladle is transported on or near the above-described rail. The position detection sensor may be a proximity switch or a laser sensor installed under the roller conveyor. Alternatively, the position detection sensor may be an encoder or a photoelectronic sensor installed on the molten metal reception carriage 4 or the transportation carriage 6.

In the casting facility 1 configured as described above, following basic operation is performed. As shown in FIG. 1, the molten metal reception carriage 4 is in a state where the molten metal reception carriage 4 carries a treatment ladle LD1 and is located under the primary inoculation device 3, and where an alloy material (primary inoculation material) is being charged into the treatment ladle LD1. A ladle serial number is issued when the alloy material is charged. When alloy charge is completed, the molten metal reception carriage 4 moves to a designated melting furnace 2 and receives raw molten metal. When molten metal reception is completed, the molten metal is emptied from the treatment ladle LD1 into an empty pouring ladle LD2. The pouring ladle LD2 is moved by the transportation carriage 6 to the roller conveyor 7 of the ladle exchange device 9. Then, the full ladle is trans-shipped to the pouring machine 10. Molds are molded by the molding machine M, are conveyed in such a way as to be moved flask by flask, and arrive at pouring positions. The pouring machine 10 moves to the pouring positions and starts pouring the molten metal. The transportation carriage 6 receives the empty ladle from the roller conveyor 8, moves to the emptying position, and receives the molten metal from the treatment ladle. Such a series of actions is repeated.

[Control System for Casting Facility]

Figure 2:
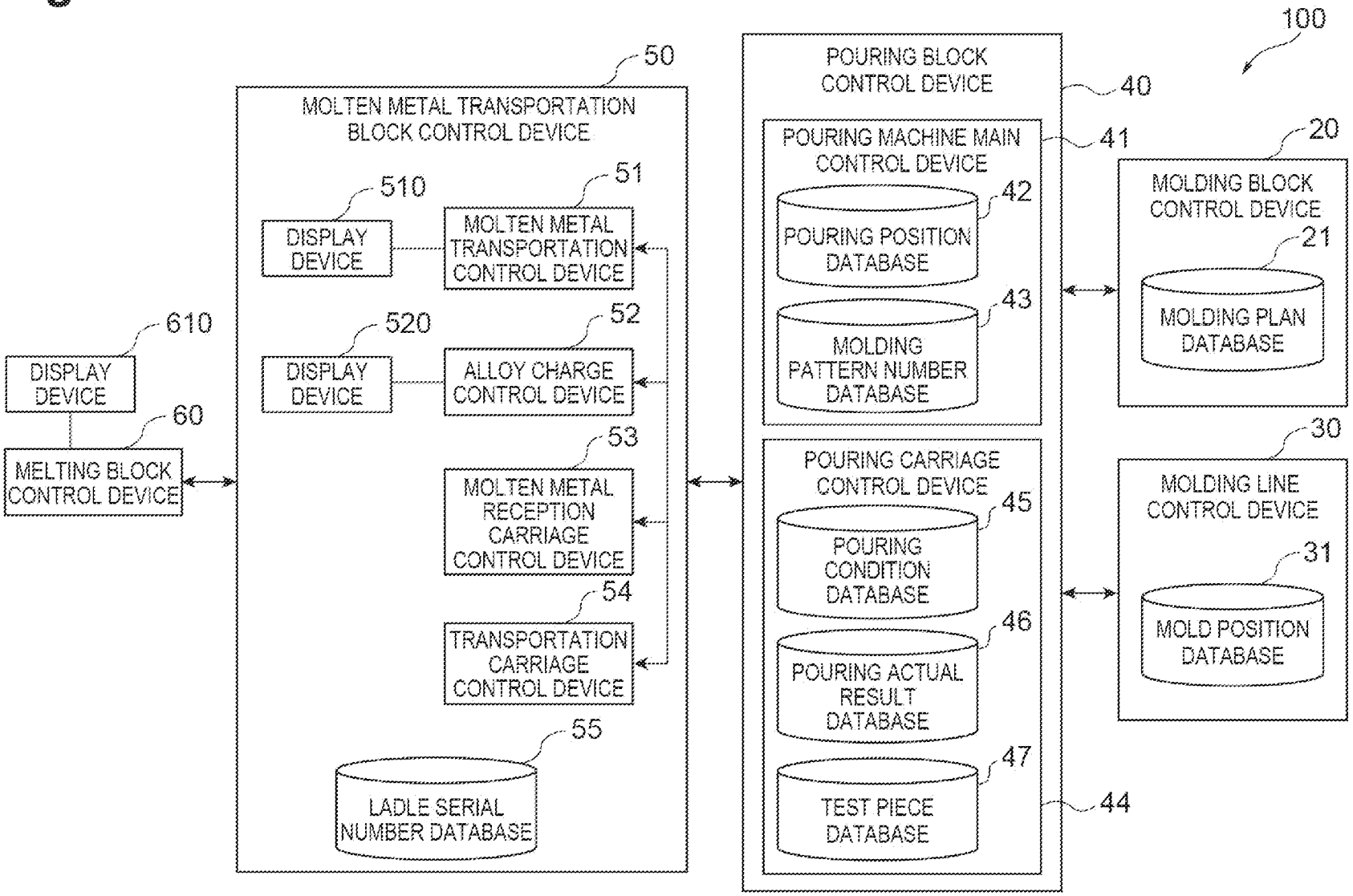
FIG. 2 is a block diagram of a control system for the casting facility in FIG. 1.

FIG. 2 is a block diagram of a control system for the casting facility in FIG. 1. As shown in FIG. 2, the control system 100 (an example of a casting facility control system) includes the molding block control device 20, the molding line control device 30, the pouring block control device 40, a molten metal transportation block control device 50, and the melting block control device 60. The devices in the drawing are configured as a general computer system including a PLC or a computer, physically, a CPU (Central Processing Unit), main storage devices (an example of a storage medium) such as a RAM (Random Access Memory) and a ROM (Read Only Memory), an input device such as a touch panel or a keyboard, an output device such as a display, a secondary storage device (an example of the storage medium) such as a hard disk, and the like.

The molding block control device 20 causes the molding machine M (FIG. 5) to operate based on a molding plan database 21. The molding plan database 21 includes mold information. The mold information is information associated with a mold, and a serial number for identifying the mold, information on a pattern used for the mold, a casting weight, and the like are included in the mold information. FIG. 3 is an example of the molding plan database. In FIG. 3, a case is illustrated in which the molding machine M is a molding machine with flask, takt time (a processing time for one flask) is 25 seconds, and the capacity of the pouring ladle LD2 is 1000 kg. As shown in FIG. 3, the molding plan database 21 includes a planned mold serial number and basic shift information associated with the planned mold serial number. The planned mold serial number is information for identifying a mold. The basic shift information is information shifted in response to movement of the mold on a mold position database 31, which will be described later. The basic shift information includes a molding pattern number and a planned casting weight (planned weight). The molding pattern number is information for identifying a pattern used for the mold. The molding pattern number is used by the pouring block control device 40 to read information related to pouring. The planned casting weight is an amount of molten metal to be poured into the mold. In the example in FIG. 3, a molding pattern number "1235" and a planned casting weight "75 kg" are associated with a planned mold serial number "1". Moreover, a molding pattern number "1234" and a planned casting weight "50 kg" are associated with a planned mold serial number "15". The molding block control device 20 is communicably connected to the pouring block control device 40.

The molding line control device 30 controls the mold feeding devices 11, 12 and updates the mold position database 31 (an example of a database). The mold position database 31 stores a plurality of conveyance positions fixedly assigned to a line of molds, and mold information corresponding to a mold positioned at each of the conveyance positions, in association with each other. The plurality of conveyance positions fixedly assigned to the line of molds are absolute positions (addresses) and indicate the same positions even if molds move. Such conveyance positions are assigned, for example, based on a position of the rear end of the conveyance line, a position where the molding machine M is disposed, or the like as a reference. In other words, in the mold position database 31, the conveyance positions, mold serial numbers, and molding pattern numbers are stored in association with each other. The molding line control device 30 (an example of an update section) updates the mold information associated with each conveyance position stored in the mold position database 31, in response to flask feeding by the mold feeding devices 11, 12. Details of updating operation will be described later.

The melting block control device 60 centrally manages information on a melting process. The melting block control device 60 is connected to the melting furnace 2, a material-to-be-melted measurement device, the material-to-be-melted charge device, the temperature sensor, the carbon analysis device, the quantovac element analysis device, the CE meter, and the like. At a time of first melting on the day, the melting block control device 60 determines material to be melted based on a production plan for the day, and causes the material-to-be-melted charge device to charge the determined material to be melted. The melting block control device 60 may cause a display device 610 to display the determined material to be melted, and thus may prescribe the material to be melted to an operator at a melting site. The melting block control device 60 is connected to the molten metal transportation block control device 50, and the devices exchange information with each other. The melting block control device 60 acquires information from the material-to-be-melted measurement device, the material-to-be-melted charge device, the temperature sensor, the carbon analysis device, the quantovac element analysis device, the CE meter, and the like, and stores melting information related to raw molten metal for each melting furnace.

The molten metal transportation block control device 50 includes a molten metal transportation control device 51, an alloy charge control device 52, a molten metal reception carriage control device 53, a transportation carriage control device 54, and a ladle serial number database 55.

The alloy charge control device 52 assigns a ladle serial number to a treatment ladle LD1 receiving raw molten metal. For example, the alloy charge control device 52 issues a ladle serial number to a treatment ladle LD1 at a timing when the treatment ladle LD1 is positioned at the primary inoculation device 3. The ladle serial number is a number assigned to a ladle and counted up. As an example, the ladle serial number is zero when the casting facility 1 is started (for example, when operation on a day is started). As an example, the ladle serial number is counted up at a timing when the molten metal reception carriage 4 heads for a molten metal reception position after an alloy material for primary inoculation is charged into the treatment ladle LD1.

The alloy charge control device 52 stores alloy charge information by the primary inoculation device 3 in the ladle serial number database 55 in association with the ladle serial number of the treatment ladle LD1 on the molten metal reception carriage 4. Examples of the alloy charge information include a type of molten metal, a clock time of charging alloy, a type and a weight of the alloy, the number of times and a time of using the ladle, and an amount of a primary inoculation material discarded.

The molten metal transportation control device 51 shifts a ladle serial number, according to the position of a ladle. For example, at a timing when the molten metal reception carriage 4 departs from the primary inoculation device 3, the molten metal transportation control device 51 causes a treatment ladle LD1 on the molten metal reception carriage 4 to take over a ladle serial number assigned at the primary inoculation device 3. In response to the fact that the content of the treatment ladle LD1 is emptied from the treatment ladle LD1 into a pouring ladle LD2 on the transportation carriage 6 (that is, at a timing when emptying is completed), the molten metal transportation control device 51 causes the pouring ladle LD2 to take over the ladle serial number of the treatment ladle LD1 on the molten metal reception carriage 4 positioned at the emptying position. At the roller conveyor 7 of the ladle exchange device 9, at a timing when the full ladle is transported in from the transportation carriage 6, the molten metal transportation control device 51 causes the ladle serial number of the full ladle on the transportation carriage 6 to be taken over as a ladle serial number of the full ladle. At a timing when the full ladle is moved from the roller conveyor 7 of the ladle exchange device 9 to the pouring machine 10, the molten metal transportation control device 51 outputs the ladle serial number of the full ladle on the roller conveyor 7 to the pouring block control device 40, which will be described later. The above-described operation of the molten metal reception carriage 4 and the transportation carriage 6 is implemented by the molten metal reception carriage control device 53 and the transportation carriage control device 54. As described above, the molten metal transportation control device 51 shifts a ladle serial number in response to movement of a ladle by the molten metal reception carriage control device 53 and the transportation carriage control device 54.

The molten metal transportation control device 51 stores the respective ladle serial numbers of a ladle positioned at the primary inoculation device 3, a ladle on the molten metal reception carriage 4, a ladle positioned at the emptying position, a ladle on the transportation carriage 6, and a ladle on the roller conveyor 7 of the ladle exchange device 9, in a storage device of the molten metal transportation control device 51.

The alloy charge control device 52 may store secondary inoculation information in the ladle serial number database 55 in association with the ladle serial number of a pouring ladle LD2 on the transportation carriage 6. Examples of the secondary inoculation information include a clock time of inoculation, a ladle number, an inoculation type and an inoculated amount, a time of completion of Mg reaction, and an amount of a secondary inoculation material discarded. Here, the ladle serial number and the ladle number are associated with each other.

The molten metal reception carriage control device 53 transfers molten metal reception information to the molten metal transportation control device 51. Examples of the molten metal reception information include a type of molten metal, a clock time of tapping, a weight of the molten metal received, a temperature of the molten metal received, a furnace number, the number of times the molten metal is received, the number of times melting is performed, and progresses of the temperature after the molten metal is received. The number of times the molten metal is received is the number of times the molten metal is supplied to a ladle. The number of times the molten metal is supplied is represented, at the melting furnace, by the number of tappings and, at the molten metal reception carriage, by the number of receptions. The molten metal transportation control device 51 stores the ladle serial number of a ladle on the molten metal reception carriage 4 and the molten metal reception information in association with each other in the ladle serial number database 55. Here, the ladle serial number, the furnace number, and the number of tappings are associated with each other. In response to the fact that raw molten metal is tapped from the melting furnace 2 into a treatment ladle LD1, the molten metal transportation control device 51 stores the ladle serial number, the furnace number, and the number of tappings in association with each other in the ladle serial number database 55. Note that the molten metal transportation control device 51 acquires a material quality number (an example of material quality information) from the melting block control device 60 and stores the material quality number in the ladle serial number database 55 in association with the ladle serial number. The material quality number is a character or a number assigned beforehand to each material quality.

FIG. 4B is an example of the ladle serial number database. As shown in FIG. 4B, the ladle serial number database 55 includes, in association with a ladle serial number, a material quality number, alloy charge information, molten metal reception information, secondary inoculation information, a fading start time, and a test piece serial number (an example of test piece identification information). The fading start time is measured based on changes in weight along with reaction with alloy material after molten metal is received. The test piece serial number is a serial number assigned to a result of material quality inspection using a test piece on the melting furnace 2.

Display devices 510, 520 are connected to the molten metal transportation control device 51 and the alloy charge control device 52, respectively, and can display various information. The information is informed to operators.

The pouring block control device 40 controls operation of the pouring machine 10. The pouring block control device 40 includes a pouring machine main control device 41 and a pouring carriage control device 44. The pouring machine main control device 41 performs control related to pouring operation of the pouring machine 10. The pouring carriage control device 44 controls operation of the pouring carriage of the pouring machine 10, and also collects and stores a result of pouring as pouring information. The pouring machine main control device 41 and the pouring carriage control device 44 are communicably connected to each other.

The pouring machine main control device 41 includes a pouring position database 42 (an example of the database) in which the conveyance positions are replaced with pouring positions. The pouring position database 42 stores a plurality of pouring positions and mold information corresponding to a mold positioned at each of the pouring positions in association with each other. Similarly to the conveyance positions, the pouring positions are absolute positions (addresses) fixedly assigned to the line of molds in the pouring zone 14, and indicate the same positions even if molds move. The pouring machine main control device 41 (an example of the update section) acquires the content of the mold position database 31 from the molding line control device 30 and updates the pouring position database 42. The pouring machine main control device 41 acquires updated information from the molding line control device 30, in response to flask feeding by the mold feeding devices 11, 12. Thus, the pouring machine 10 can grasp mold information on a mold positioned at each pouring position.

The pouring machine main control device 41 includes a molding pattern number database 43. The molding pattern number database 43 stores a pouring condition for each pattern. FIG. 4A is an example of the molding pattern number database. The molding pattern number database 43 stores a molding pattern number that is an identification number of a pattern used for a mold, in association with a planned casting weight, a planned material quality number, planned pouring pattern number, a planned pouring temperature, and the like. The planned casting weight is a preset weight of molten metal to be flowed into a mold. The planned material quality number is a preset material quality number. A pouring pattern is a pattern indicating a relationship between a pouring weight and a time of pouring, a pouring pattern number is a character or a number assigned to identify a pouring pattern, and the planned pouring pattern number is a preset pouring pattern number. The planned pouring temperature is a preset temperature of molten metal. The pouring machine main control device 41 references the molding pattern number database 43 based on a molding pattern number associated with a mold, and thereby can grasp a pouring condition for the mold.

The pouring carriage control device 44 includes a pouring condition database 45. The pouring condition database 45 stores the same content as the molding pattern number database 43. The pouring carriage control device 44 controls the pouring carriage of the pouring machine 10, based on a pouring condition stored in the molding pattern number database 43. Note that when the pouring carriage control device 44 can reference the molding pattern number database 43, the pouring carriage control device 44 does not need to include the pouring condition database 45.

The pouring carriage control device 44 (an example of an acquisition section) collects and stores pouring information (an example of actual result data) in a pouring actual result database 46. When a full ladle is transported into the pouring machine 10, the pouring carriage control device 44 acquires the ladle serial number of the full ladle from the molten metal transportation block control device 50. The pouring information is information obtained in a pouring process, and a ladle serial number, a time passing after the molten metal is received, a casting weight, a casting time, a material quality number, a pouring temperature, a fading start time, a test piece serial number, and the like are included in the pouring information, as an example. When pouring is completed, the pouring carriage control device 44 stores the pouring information in the pouring actual result database 46 by using a mold serial number for a reference.

The pouring carriage control device 44 stores a result of material quality inspection on a test piece collected from molten metal in each pouring ladle LD2 in association with a test piece serial number in a test piece database 47.

[Details of Mold Information Update in Mold Position Database]

Figure 5:
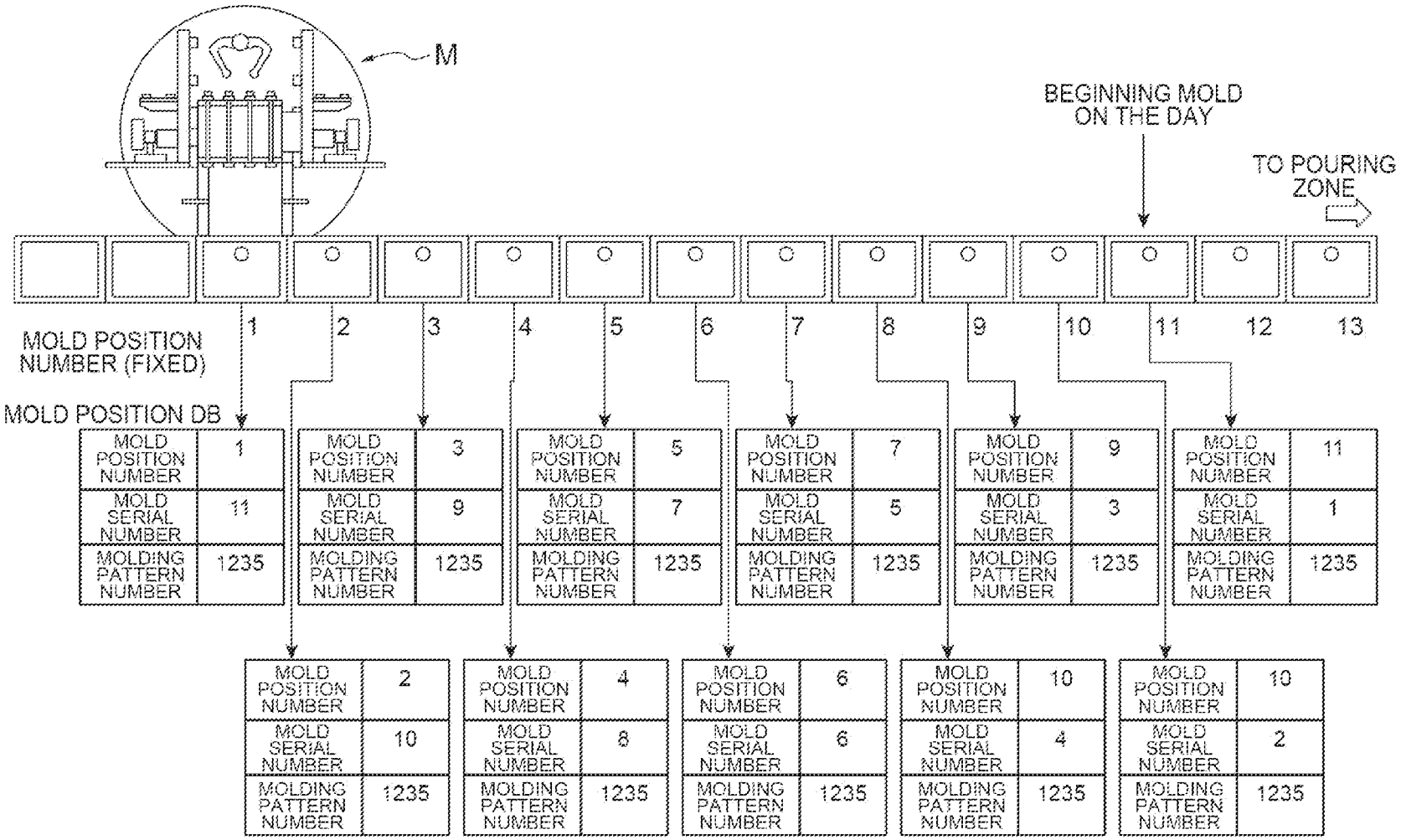
FIG. 5 is a diagram describing a mold position database that is updated in response to movement of a mold.

FIG. 5 is a diagram describing the mold position database that is updated in response to movement of a mold. As described above, the mold position database 31 stores a conveyance position, a mold serial number, a molding pattern number, and a planned casting weight in association with each other. As shown in FIG. 5, mold position numbers "1", "2", "3", . . . , "13" are assigned, starting from the molding machine M toward the pouring zone. The mold position numbers are an example of the plurality of conveyance positions fixedly assigned to the line of molds. The mold serial numbers are assigned to the molds in order from a beginning mold on the day. When the first mold on the day is molded, the mold is placed at a position corresponding to the mold position number "1". In connection with this, a mold serial number "1" is stored in association with the mold position number "1" along with a molding pattern number "1235". The molding pattern number "1235" is acquired from the molding plan database 21 shown in FIG. 3. Subsequently, the mold is moved by one flask from the molding machine M toward the pouring zone, and a second mold is molded. Movement of the mold is detected by a sensor. The mold with a mold serial number "2" is placed at the position corresponding to the mold position number "1", and the mold with the mold serial number "1" is placed at a position corresponding to the mold position number "2". Accordingly, when movement of the mold is detected by the sensor, the mold serial number "2" is stored in association with the mold position number "1" along with a molding pattern number "1235", and the mold serial number "1" is stored in association with the mold position number "2" along with the molding pattern number "1235", on the molding plan database 21. In such a manner, each time molds are moved by one flask, a mold serial number associated with a mold position number is shifted on the molding plan database 21. In the example shown in FIG. 5, an eleventh mold is molded, and the mold with the mold serial number "1" is placed at a position corresponding to the mold position number "11", and in connection with this, ten shifts are made on the mold position database 31, so that the mold position number "11", the mold serial number "1", and the molding pattern number "1235" are stored in association with each other. As described above, the mold position database 31 is updated in response to detection of movement of a mold.

[Details of Mold Information Update in Pouring Position Database]

Figure 6:
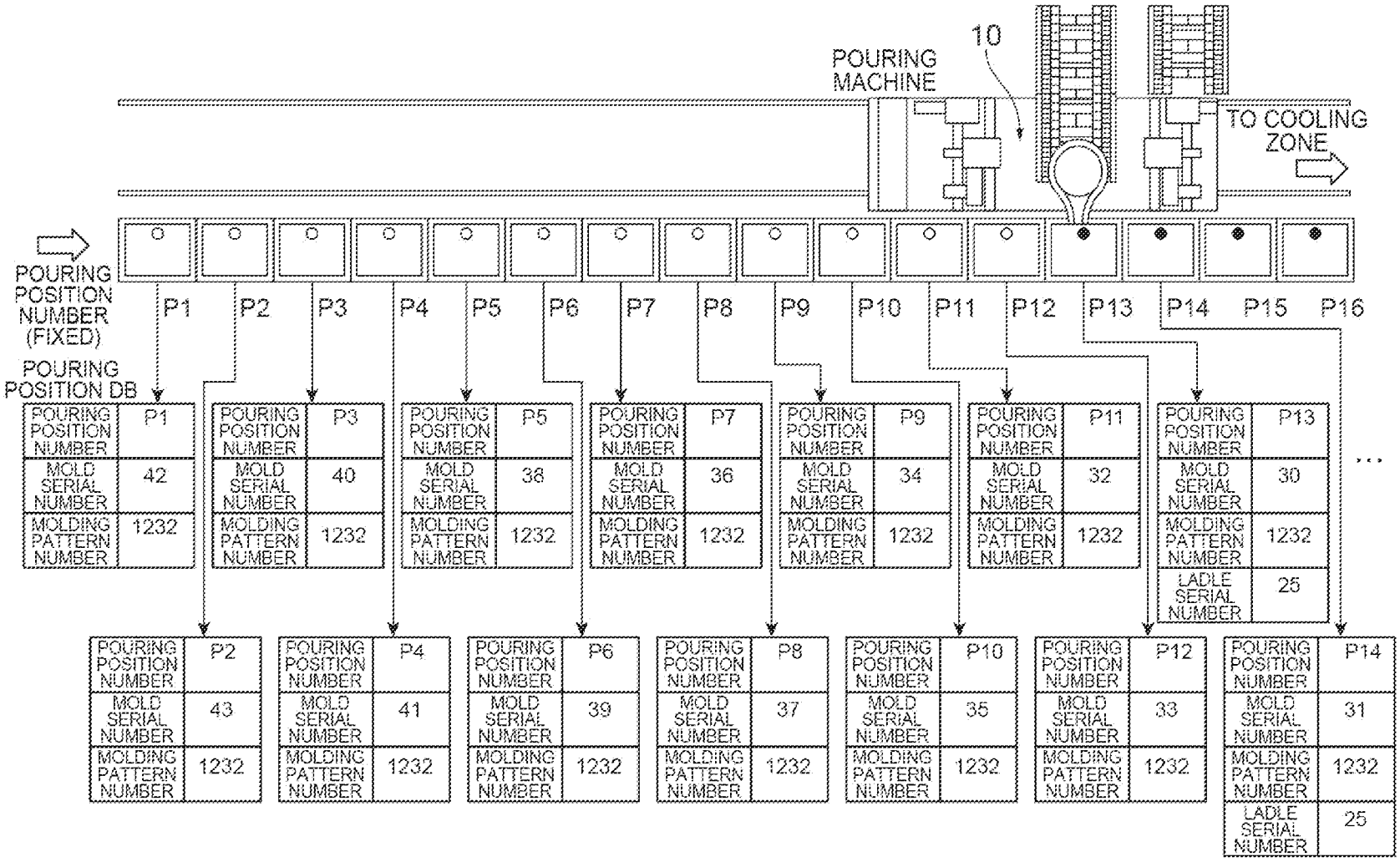
FIG. 6 is a diagram describing, according to movement of molds, a pouring position database that is updated in response to movement of a mold.

FIG. 6 is a diagram describing the pouring position database that is updated in response to movement of a mold. As described above, the pouring position database 42 stores a conveyance position, a mold serial number, and a molding pattern number in association with each other.

As shown in FIG. 6, in the pouring zone, pouring position numbers "P1", "P2", "P3", . . . , "P16" are assigned. The pouring position numbers are an example of the plurality of conveyance positions fixedly assigned to the line of molds. Note that a mold position number indicating the pouring position number "P1" is preset. For example, when the mold position number indicating the pouring position number "P1" is "40", mold information on a mold position number "39" is transmitted from the molding line control device 30 to the pouring machine main control device 41 when mold information on the mold position number "39" in the mold position database 31 is shifted, and the pouring position number "P1" and the mold information on the mold position number "39" are stored in association with each other. In such a manner, taking over of data is performed. The pouring machine main control device 41 references a molding pattern number associated with a pouring position number in the pouring position database 42, reads pouring conditions including a planned casting weight, planned material quality, a planned pouring pattern number, and a planned pouring temperature from the molding pattern number database 43, and then pours molten metal. The example in FIG. 6 shows a state in which pouring into a mold positioned at the pouring position number "P13" is completed. When pouring is completed, the pouring machine main control device 41 adds a ladle serial number to the pouring position database 42.

[Plan Coordination and Quality Checking]

Here, a configuration for coordinating the molding plan and the melting plan and a configuration for checking quality are described. Generally, a molding machine molds a mold by seconds, a melting furnace melts raw material by hours, and a pouring machine pours molten metal by seconds or by minutes. Accordingly, the molding machine or the pouring machine waits for melting by the melting furnace to be completed in some cases, depending on a timing. In a conventional facility, fabrication instructions are individually made to a molding process and a melting process, and there is no means for actively coordinating a molding plan and a melting plan. Moreover, although an example exists in which an across-the-board fabrication instruction is issued from a higher-order control device based on a production plan on the day, a measure of preparing extra molten metal in a melting furnace is taken in order to avoid a situation in which completion of melting by the melting furnace is awaited. However, since extra molten metal is prepared and transported, it cannot be said that molding efficiency is sufficient according to such a measure. If a molding plan and a melting plan can be coordinated, fabrication of molten metal only in a minimum necessary, appropriate amount will suffice. Moreover, it can be said that coordination between a molding plan and a melting plan can result in good castings being able to be produced.

Production of good castings requires an automated pouring machine that pours, at a stable pace, molten metal adjusted to components as originally planned and having viscosity as planned. The components as planned are guaranteed by the fact that a material quality number of molten metal whose components are adjusted from melting matches a planned material quality number of a mold. The viscosity as planned is achieved by the fact that a molten metal temperature matches a planned temperature. Pouring molten metal at a stable pace is achieved by controlling a flow rate based on a planned pouring pattern, and is guaranteed by strengthening a check when pouring is performed by using melting data at a pouring site. In other words, in a pouring facility, a configuration of sharing plans and a configuration of performing a check based on an actual result contribute to production of good castings.

Figure 7:
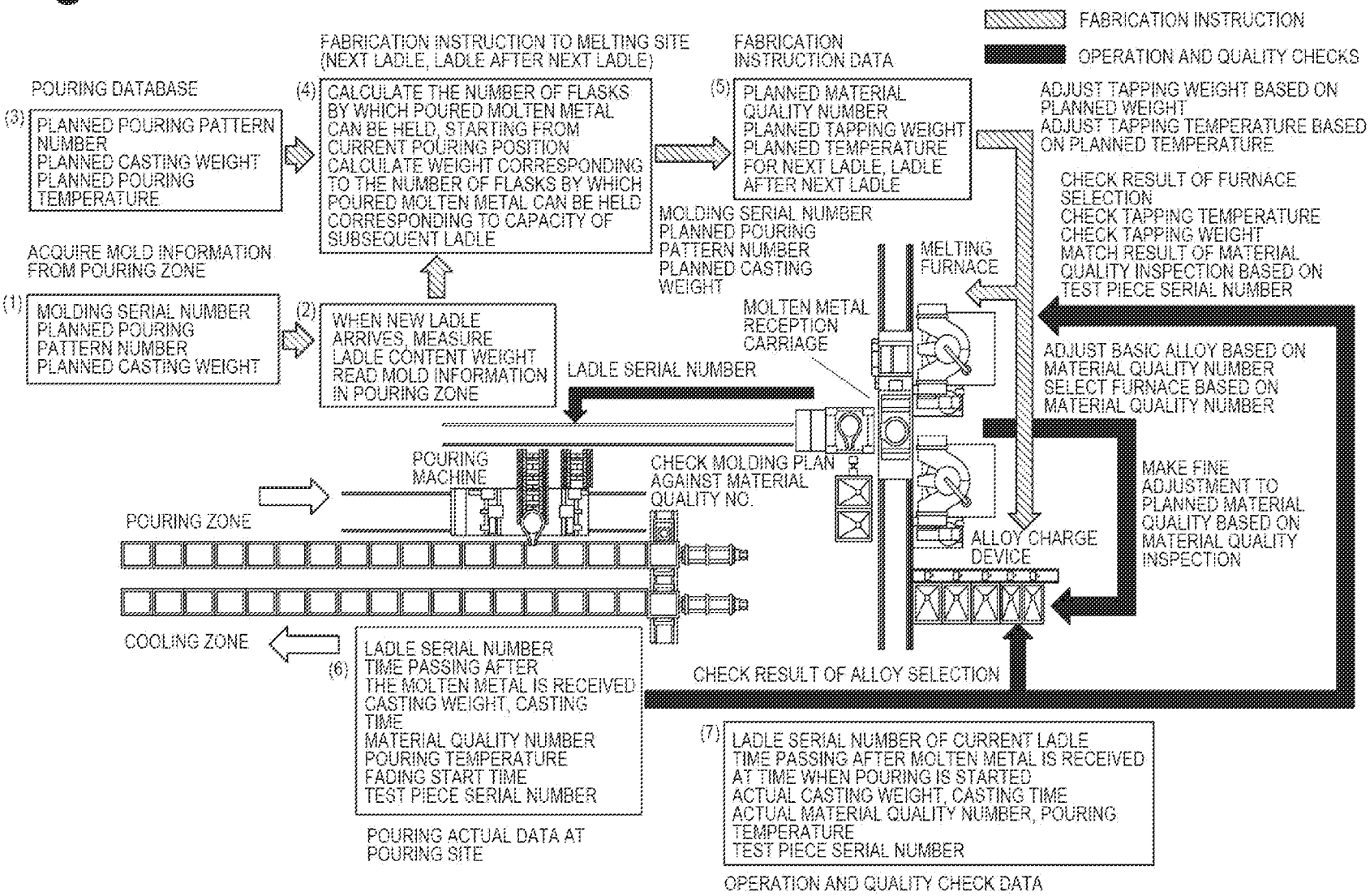
FIG. 7 is a diagram describing an outline of fabrication instruction and operation and quality checking in the casting facility.

FIG. 7 is a diagram describing an outline of a fabrication instruction in the casting facility and operation and quality checks. Item numbers (1) to (5) shown in FIG. 7 describe the fabrication instruction in the casting facility, and item numbers (6), (7) describe the operation and quality checks.

The pouring block control device 40 includes a function of performing the item numbers (1) to (5). The pouring block control device 40 creates fabrication instruction data when a new ladle arrives at the pouring machine 10. The new ladle is a ladle that has received raw molten metal first tapped after melting by the melting furnace 2 is completed. In other words, the new ladle is determined for each melting furnace 2, and is determined in each melting cycle. The fabrication instruction data is data including an instruction to the melting site. In other words, the fabrication instruction data is data including an instruction related to molten metal to be transported from the next time onwards and raw molten metal to be fabricated from the next time onwards. The fabrication instruction data includes, as an example, a weight of molten metal in a ladle.

When the new ladle arrives at the pouring machine 10, the pouring carriage control device 44 (an example of a measurement section) measures the weight of molten metal in the pouring ladle LD2 transported to the pouring machine 10 by the transportation carriage 6. The pouring carriage control device 44 measures the weight of the molten metal, for example, based on an output of a load cell installed on the pouring carriage. Moreover, the pouring machine main control device 41 acquires a mold serial number and a molding pattern number as mold information from the pouring zone. Specifically, the pouring machine main control device 41 acquires the mold serial number and the molding pattern number by referencing the pouring position database 42. The pouring machine main control device 41 acquires a planned pouring pattern number and a planned casting weight by referencing the molding pattern number database 43, based on the molding pattern number (item numbers (1), (2)).

Subsequently, the pouring carriage control device 44 (an example of a calculation section) calculates the number of flasks by which the molten metal poured from the pouring ladle LD2 transported to the pouring machine 10 can be held, based on the planned casting weight (an example of a planned weight of molten metal) acquired by the pouring machine main control device 41. The number of flasks by which the poured molten metal can be held is the number of molds for which pouring can be completed. For example, the pouring carriage control device 44 references the pouring position database 42, sequentially adds the planned casting weights for molds to be next subjected to pouring, and sets, as the number of flasks by which the poured molten metal can be held, the number of molds with which a total planned casting weight is the weight of the molten metal in the pouring ladle LD2 or less and reaches a maximum (item number (4)).

Subsequently, the pouring carriage control device 44 (an example of a decision section) recognizes a plurality of molds into which molten metal to be next transported to the pouring machine 10 is poured, based on the number of flasks by which the poured molten metal can be held. For example, when the number of flasks by which the poured molten metal can be held is "7", seven molds that are conveyed from now to the pouring positions in the pouring machine 10 are molds to be subjected to pouring from the current pouring ladle LD2. The pouring carriage control device 44 recognizes seven molds to be transported after the above-mentioned molds, as the molds into which molten metal to be next transported to the pouring machine 10 is poured. The pouring carriage control device 44 references the pouring condition database 45, based on a mold serial number corresponding to each of the recognized molds, and acquires a planned pouring pattern number, a planned casting weight, and a planned pouring temperature (item number (3)). Then, the pouring carriage control device 44 adds up the planned casting weight corresponding to each of the recognized molds, and sets the total as a planned tapping weight (an example of a predicted weight) for a next ladle (item number (4)). Thus, the weight of the molten metal to be next transported to the pouring machine 10 becomes equal to a weight obtained by adding up the planned weights of molten metal corresponding to the plurality of molds determined depending on the number of flasks by which the poured molten metal can be held calculated based on the measured weight of the molten metal in the ladle and the planned weights of molten metal associated with the individual conveyance positions.

The pouring carriage control device 44 (an example of an output section) outputs the determined planned tapping weight as fabrication instruction data on the melting furnace 2 (item number (5)). The pouring carriage control device 44 may calculate a planned tapping weight for a further next ladle (a ladle after the next ladle). The pouring carriage control device 44 similarly adds up a planned casting weight corresponding to each of as many molds to be conveyed after the molds corresponding to the next ladle as the number of flasks by which the poured molten metal can be held, and sets the total as a planned tapping weight for the ladle after the next ladle.

The pouring carriage control device 44 may have the fabrication instruction data include a planned temperature of molten metal. The planned temperature of molten metal is determined based on a planned temperature of molten metal for each of the molds recognized to be subjected to pouring from the next ladle. The pouring carriage control device 44 may have the fabrication instruction data include a planned material quality number of molten metal (an example of planned material quality information). The planned material quality number of molten metal is determined based on a planned material quality number of molten metal for each of the molds recognized to be subjected to pouring from the next ladle.

The fabrication instruction data outputted from the pouring carriage control device 44 is outputted to the molten metal transportation block control device 50. The fabrication instruction data may be displayed on each of the respective display devices 510, 520 of the molten metal transportation control device 51 and the alloy charge control device 52. The fabrication instruction data is outputted to the melting block control device 60 via the molten metal transportation block control device 50. Thus, the planned tapping weight, the planned material quality number, and the planned temperature related to the next ladle are informed to operators for melting operation, molten metal transportation operation, and alloy charge operation. The operators adjust the tapping weight of the melting furnace 2 based on the planned tapping weight, and adjust the tapping temperature of the melting furnace 2 based on the planned temperature. The operators adjust alloy in the primary inoculation device 3 based on the planned material quality number, and determine, based on the planned material quality number, a melting furnace from which the molten metal reception carriage 4 receives molten metal.

Next, the operation and quality checks on the casting facility 1 are described. As described above, the pouring actual result database 46 includes, in association with a ladle serial number, a material quality number, alloy charge information, molten metal reception information, secondary inoculation information, a fading start time, and a test piece serial number (item number (6)). The information stored in the pouring actual result database 46 is used for operation and quality checks on a molten metal transportation process. For example, the pouring carriage control device 44 performs a check of a result of alloy selection, a check of a result of furnace selection, a check of a tapping temperature, a check of a tapping weight, matching of a result of material quality inspection using a test piece serial number from the test piece database 47, and the like (item number (7)). The pouring carriage control device 44 outputs results of the inquiring checks to the molten metal transportation block control device 50 and the melting block control device 60. An operator confirms an actual result of alloy selection based on the results of the inquiring checks, and adjusts the tapping temperature of the melting furnace 2 and the alloy in the primary inoculation device 3 when necessary. Further, the pouring carriage control device 44 acquires a result of material quality inspection on the melting furnace 2, based on the test piece serial number stored in the ladle serial number database 55. The result of material quality inspection is, for example, a sulfur value or the like obtained by the carbon analysis device, the quantovac element analysis device, the CE meter, or the like. The pouring carriage control device 44 outputs the result of material quality inspection to the molten metal transportation block control device 50. An operator confirms the result of material quality inspection, and adjusts the alloy in the primary inoculation device 3 when necessary.

The pouring carriage control device 44 may acquire the ladle serial number of a ladle arriving at the pouring machine 10 and may output a material quality number (an example of actual result data) associated with the ladle serial number to the pouring machine main control device 41. The pouring machine main control device 41 (an example of a determination section) acquires a planned material quality number corresponding to a pouring-target mold, matches the planned material quality number against a material quality number associated with the ladle serial number, and determines whether or not execution of pouring is allowed. When the material quality number matches, the pouring machine main control device 41 continues pouring. When the material quality number does not match, the pouring machine main control device 41 suspends pouring. In such a case, molten metal in the pouring ladle LD2 is transported to a different place and is reused after cooled.

(Fabrication Instruction Processing)

Figure 8:
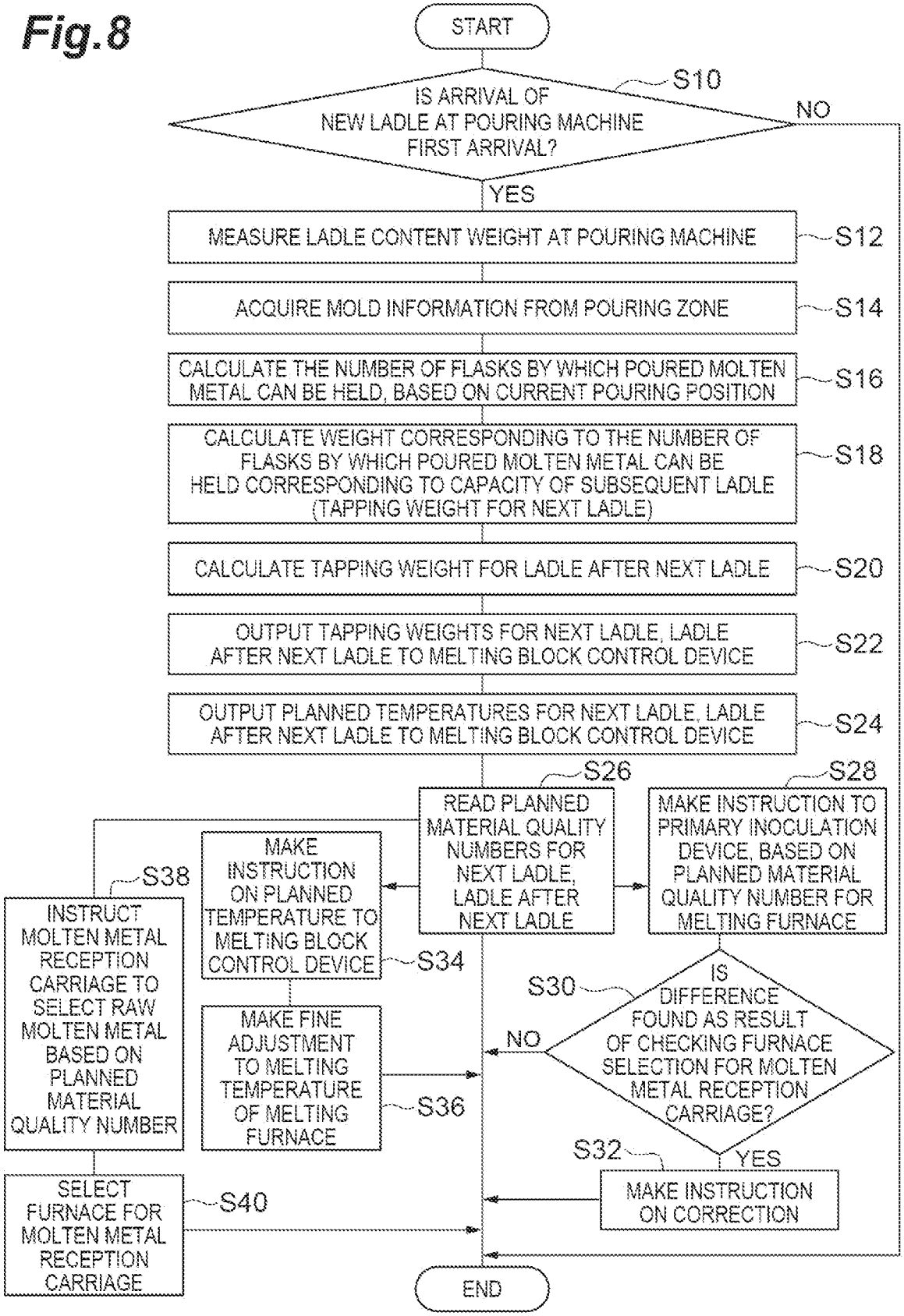
FIG. 8 is a flowchart showing fabrication instruction processing.

The above-described fabrication instruction processing is described in a time series. FIG. 8 is a flowchart showing the fabrication instruction processing. The flowchart shown in FIG. 8 is executed by the pouring block control device 40, and is executed, for example, on a fixed-cycle start basis such as at 0.05-second intervals.

As shown in FIG. 8, first, when a pouring ladle LD2 arrives at the pouring machine 10, the pouring carriage control device 44 of the pouring block control device 40 determines whether or not the arrival is a first arrival of a new ladle, as step S10. When it is determined that the arrival is a first arrival of a new ladle (step S10: YES), the pouring carriage control device 44 measures a ladle content weight in the pouring ladle LD2, as step S12. The ladle content weight is stored in the pouring actual result database 46.

Subsequently, the pouring carriage control device 44 calculates the number of flasks by which the poured molten metal can be held, based on planned casting weights from pouring positions at a current time point and the ladle content weight, as step S16. The pouring machine main control device 41 reads a molding serial number and a molding pattern number from the pouring position database 42. The pouring carriage control device 44 acquires a planned casting weight, planned material quality, and a planned pouring pattern number from the molding pattern number database 43. The pouring carriage control device 44 sets the number of molds with which a total planned casting weight is the weight of the molten metal in the pouring ladle LD2 or less and reaches a maximum, as the number of flasks by which the poured molten metal can be held.

Subsequently, the pouring carriage control device 44 calculates a weight of molten metal corresponding to the number of flasks by which the poured molten metal can be held, and sets the calculated weight as a tapping weight for a next ladle, as step S18. Similarly, the pouring carriage control device 44 calculates a tapping weight for a ladle after the next ladle, as step S20.

Subsequently, the pouring carriage control device 44 outputs the calculated tapping weights for the next ladle and the ladle after the next ladle to the melting block control device 60 via the molten metal transportation block control device 50, as step S22. Similarly, the pouring carriage control device 44 acquires planned temperatures for the next ladle and the ladle after the next ladle from the molding pattern number database 43, and outputs the planned temperatures to the melting block control device 60 via the molten metal transportation block control device 50, as step S24.

Subsequently, the pouring carriage control device 44 reads planned material quality numbers for the next ladle and the ladle after the next ladle, as step S26. Then, the pouring carriage control device 44 instructs the planned temperatures to the melting block control device 60 via the molten metal transportation block control device 50 (step S34). The melting block control device 60 displays the planned temperatures on the display device 610. An operator confirms the planned temperatures and makes a fine adjustment to the melting temperature of the melting furnace 2 when necessary, as step S36.

In parallel with step S34, the pouring carriage control device 44 outputs the planned material quality numbers to the molten metal transportation block control device 50, and instructs the molten metal reception carriage 4 to select raw molten metal (step S38). The molten metal transportation block control device 50 selects a melting furnace 2 from which the molten metal reception carriage 4 receives molten metal, based on the planned material quality numbers, as step S40.

In parallel with step S34, the pouring carriage control device 44 outputs the planned material quality numbers to the molten metal transportation block control device 50, and instructs the alloy charge control device 52 to select an alloy material based on the planned material quality numbers (step S28). The molten metal transportation block control device 50 matches the melting furnace 2 from which the molten metal reception carriage 4 receives molten metal against the planned material quality numbers and determines whether or not there is a difference, as step S30. When it is determined that there is a difference, the molten metal transportation block control device 50 corrects selection of an alloy material, as step S32.

When it is determined that the arrival is not a first arrival of a new ladle (step S10: NO), or when all steps are finished, the flowchart shown in FIG. 8 is terminated. The flowchart shown in FIG. 8 is executed, whereby the molding plan and the melting plan can be coordinated.

(Operation and Quality Checking Processing)

Figure 9:
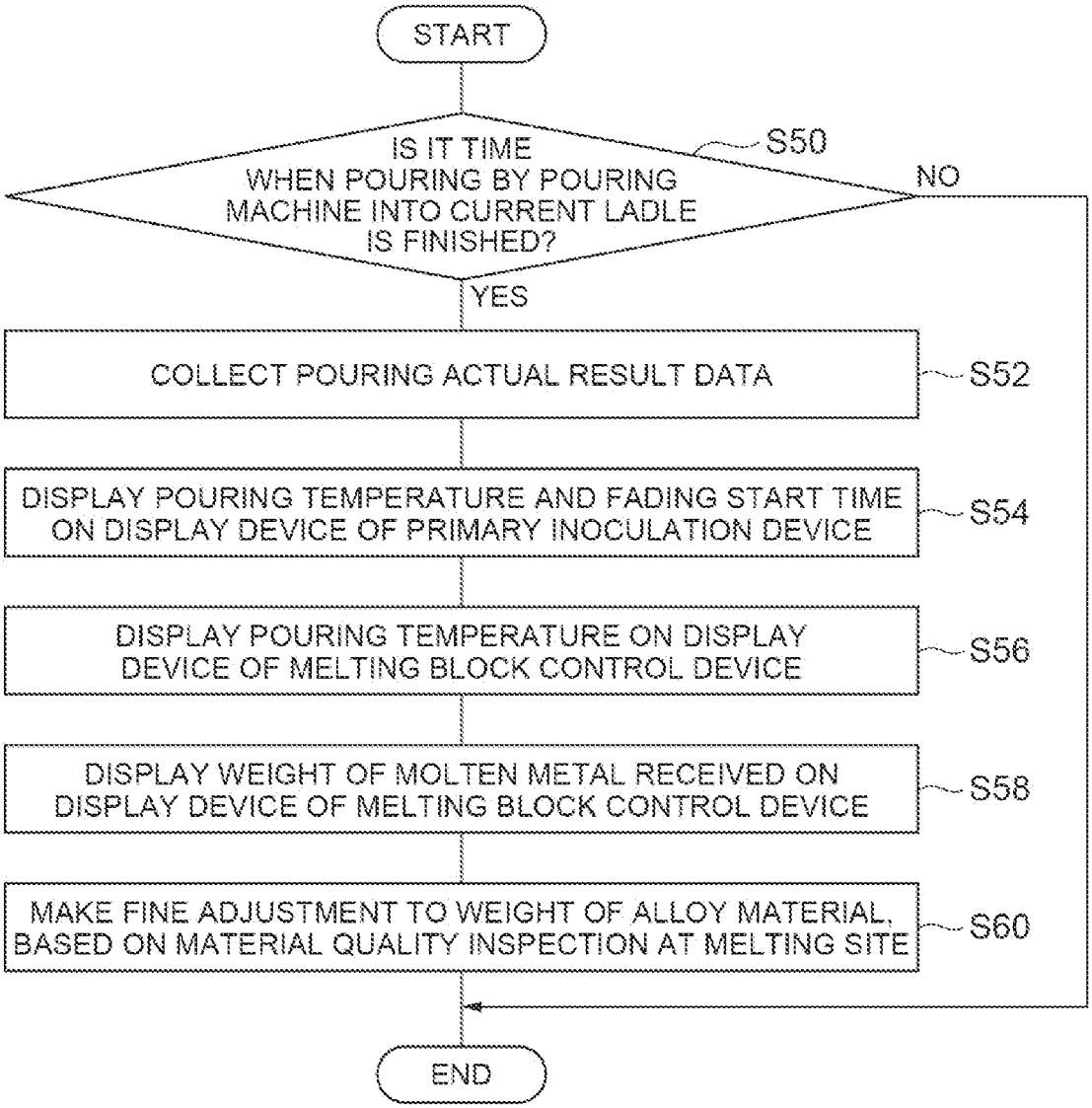
FIG. 9 is a flowchart showing operation and quality checking processing.

The above-described operation and quality checking processing is described in a time series. FIG. 9 is a flowchart showing the operation and quality checking processing. The flowchart shown in FIG. 9 is executed by the pouring block control device 40, and is executed, for example, on a fixed-cycle start basis such as at 0.05-second intervals.

As shown in FIG. 9, first, the pouring carriage control device 44 of the pouring block control device 40 determines whether or not it is a time when pouring by the pouring machine 10 into a current ladle is finished, as step S50. The determination is to make an instruction at a first time that is the time when pouring by the pouring machine 10 into the current ladle is finished. When it is determined that it is a time when pouring by the pouring machine 10 into the current ladle is finished (step S50: YES), the pouring carriage control device 44 collects pouring actual result data, as step S52. The pouring carriage control device 44 collects the pouring actual result data such as a ladle serial number, a weight of molten metal received, a time passing after the molten metal is received, a casting weight, a casting time, a material quality number, a pouring temperature, and a fading start time at a pouring position number, measures the ladle content weight in the pouring ladle LD2, and stores the collected data and the measured weight in the pouring actual result database 46.

Subsequently, the pouring carriage control device 44 outputs the pouring actual result data to the molten metal transportation block control device 50, and the display device 520 of the primary inoculation device 3 is caused to display the pouring temperature and the fading start time, as step S54. An operator confirms a result of alloy selection, and a result of furnace selection to be indicated to the molten metal reception carriage 4, based on the display on the display device 520. Note that when an allowable fading start time is exceeded, the molten metal is transported to a different place and is reused after cooled, or is drained.

Subsequently, the pouring carriage control device 44 outputs the pouring actual result data to the melting block control device 60 via the molten metal transportation block control device 50, and the display device 610 in front of the melting furnace 2 is caused to display the pouring temperature, as step S56. An operator confirms a tapping temperature, based on the display on the display device 610.

Subsequently, the pouring carriage control device 44 outputs the pouring actual result data to the melting block control device 60 via the molten metal transportation block control device 50, and the display device 610 in front of the melting furnace 2 is caused to display the weight of the molten metal received, as step S58. The operator confirms a tapping weight, based on the display on the display device 610.

Subsequently, the pouring carriage control device 44 outputs a result of material quality inspection (for example, a sulfur value or the like) at the melting site to the molten metal transportation block control device 50, and the display device 520 of the primary inoculation device 3 is caused to display the result of material quality inspection, as step S60. The operator makes a fine adjustment to the weight of an alloy material, based on the display on the display device 520.

When it is determined that it is not a time when pouring by the pouring machine 10 into the current ladle is finished (step S50: NO), or when all steps are finished, the flowchart shown in FIG. 9 is terminated. The flowchart shown in FIG. 9 is executed, whereby a result of pouring can be reflected in the melting plan.

(Summary of the Embodiments)

In the control system 100 for the casting facility 1, the weight of molten metal in a ladle transported to the pouring machine 10 is measured, and the number of flasks by which the molten metal poured from the ladle transported to the pouring machine 10 can be held is calculated based on the measured weight of molten metal and a planned weight of molten metal included in mold information associated with each conveyance position stored in a database. Then, a plurality of molds into which molten metal to be next transported to the pouring machine 10 is poured are recognized, based on the calculated number of flasks that can hold the poured molten metal. A planned weight of molten metal corresponding to each of the recognized molds is added up, and a predicted weight of molten metal to be next transported to the pouring machine 10 is determined. The determined predicted weight is outputted as fabrication instruction data on the melting furnace 2. As described above, the control system 100 can determine the predicted weight of the next molten metal, based on the planned weights of molten metal, and can reflect the predicted weight in the fabrication instruction data on the melting furnace 2. Thus, an appropriate weight of molten metal according to the molding plan is transported. Accordingly, the control system 100 can coordinate the molding plan and the melting plan.

The control system 100 can determine a temperature and material quality information for the molten metal to be next transported, based on the planned temperatures and planned material quality information corresponding to the plurality of molds into which the molten metal to be next transported is poured, and can reflect the determined temperature and material quality information in the fabrication instruction data on the melting furnace 2.

The control system 100 can record actual result data for each ladle, and therefore can verify, for example, whether or not molten metal transported to the pouring machine 10 is as planned.

In the control system 100, execution of pouring is determined based on information grasped before pouring, such as the weight of molten metal received, the temperature of the molten metal received, a time passing after the molten metal is received, and material quality information. Accordingly, the control system 100 can avoid pouring that is different from a plan.

When a mold arrives at a pouring position, as well as when a new ladle arrives, the control system 100 can make a check and a correction with no difference from a fabrication instruction that is a criterion for a molten metal plan. The control system 100 can make a fabrication instruction to a subsequent process. Moreover, since the control system 100 can feed back pouring actual result data to a subsequent process when pouring is completed, the quality of castings is stabled.

Although a variety of exemplary embodiments have been described hereinbefore, various omissions, replacements, and changes may be made without being limited to the above-described exemplary embodiments. For example, when the number of ladles to be used is small, ladle serial numbers do not need to be used.

Although the molten metal in the melting furnace 2 is poured into the treatment ladle LD1 on the molten metal reception carriage 4, and the molten metal in the treatment ladle LD1 is emptied into the pouring ladle LD2 on the transportation carriage 6, the treatment ladle LD1 may not be used for the casting facility 1. In this case, the pouring ladle LD2 is placed on the molten metal reception carriage 4 in place of the treatment ladle LD1. The molten metal in the melting furnace 2 is poured into the pouring ladle LD2 on the molten metal reception carriage 4, and the pouring ladle LD2 is transferred from the molten metal reception carriage 4 to the transportation carriage 6. As described above, the emptying may be not performed in the casting apparatus 1.

REFERENCE SIGNS LIST

1 . . . casting facility, 2 . . . melting furnace, 3 . . . primary inoculation device, 4 . . . molten metal reception carriage (an example of ladle transportation device), 5 . . . secondary inoculation device, 6 . . . transportation carriage (an example of ladle transportation device), 9 . . . ladle exchange device, 10 . . . pouring machine, 30 . . . molding line control device (an example of update section), 31 . . . mold position database (an example of database), 41 . . . pouring machine main control device (an example of update section, determination section), 42 . . . pouring position database (an example of database), 44 . . . pouring carriage control device (an example of measurement section, calculation section, decision section, acquisition section, output section), 46 . . . pouring actual result database, M . . . molding machine, 100 . . . control system (an example of casting facility control system).

What is claimed is:

1. A casting facility control system controlling a casting facility, the casting facility including a molding machine, a mold conveyance device, a melting furnace, a ladle transportation device, and a pouring machine, the molding machine molding a plurality of molds, the mold conveyance device arranging in a line and conveying the plurality of molds molded by the molding machine, the melting furnace melting material to be melted, the ladle transportation device transporting a ladle, the pouring machine pouring molten metal in the ladle transported by the ladle transportation device into the plurality of molds conveyed by the mold conveyance device, the casting facility control system comprising:

a database configured to store a plurality of conveyance positions fixedly assigned to the line of molds, and mold information corresponding to a mold positioned at each of the conveyance positions in association with each other;

an update section configured to update the mold information associated with each of the conveyance positions stored in the database, in response to flask feeding by the mold conveyance device;

a measurement section configured to measure a weight of the molten metal in the ladle transported to the pouring machine by the ladle transportation device;

a calculation section configured to calculate a number of flasks by which the molten metal poured from the ladle transported to the pouring machine can be held, based on the weight of the molten metal measured by the measurement section and on a planned weight of molten metal included in the mold information associated with each of the conveyance positions stored in the database;

a decision section configured to recognize, based on the number of flasks by which the poured molten metal can be held calculated by the calculation section, the plurality of molds into which the molten metal to be next transported to the pouring machine is poured, add up the planned weight of molten metal corresponding to each of the recognized molds, and determine a predicted weight of molten metal to be next transported to the pouring machine; and an output section configured to output the predicted weight determined by the decision section, as fabrication instruction data on the melting furnace.

2. The casting facility control system according to claim 1, wherein the mold information further includes a planned temperature of molten metal to be poured into a corresponding mold, the decision section determines a temperature of the molten metal to be next transported to the pouring machine, based on the planned temperature of molten metal for each of the recognized molds, and the output section outputs the temperature determined by the decision section, as the fabrication instruction data.

3. The casting facility control system according to claim 2, wherein the mold information further includes planned material quality information on molten metal to be poured into a corresponding mold, the decision section determines material quality information on the molten metal to be next transported to the pouring machine, based on the planned material quality information on molten metal for each of the recognized molds, and the output section outputs the material quality information determined by the decision section, as the fabrication instruction data.

4. The casting facility control system according to claim 3, further comprising:

an acquisition section configured to acquire actual result data on the pouring machine; and a pouring actual result database configured to store the actual result data acquired by the acquisition section and identification information on the ladle in association with each other.

5. The casting facility control system according to claim 4, wherein the actual result data includes at least one of a weight of molten metal received, a temperature of the molten metal received, a time passing after the molten metal is received, a pouring temperature, a fading start time, the material quality information, and test piece identification information.

6. The casting facility control system according to claim 4, further comprising a determination section configured to determine whether or not execution of pouring is allowed, by matching the mold information corresponding to a pouring-target mold against the actual result data.

7. The casting facility control system according to claim 2, further comprising:

an acquisition section configured to acquire actual result data on the pouring machine; and a pouring actual result database configured to store the actual result data acquired by the acquisition section and identification information on the ladle in association with each other.

8. The casting facility control system according to claim 7, wherein the actual result data includes at least one of a weight of molten metal received, a temperature of the molten metal received, a time passing after the molten metal is received, a pouring temperature, a fading start time, material quality information, and test piece identification information.

9. The casting facility control system according to claim 8, further comprising a determination section configured to determine whether or not execution of pouring is allowed, by matching the mold information corresponding to a pouring-target mold against the actual result data.

10. The casting facility control system according to claim 7, further comprising a determination section configured to determine whether or not execution of pouring is allowed, by matching the mold information corresponding to a pouring-target mold against the actual result data.

11. The casting facility control system according to claim 1, wherein the mold information further includes planned material quality information on molten metal to be poured into a corresponding mold, the decision section determines material quality information on the molten metal to be next transported to the pouring machine, based on the planned material quality information on molten metal for each of the recognized molds, and the output section outputs the material quality information determined by the decision section, as the fabrication instruction data.

12. The casting facility control system according to claim 11, further comprising:

an acquisition section configured to acquire actual result data on the pouring machine; and a pouring actual result database configured to store the actual result data acquired by the acquisition section and identification information on the ladle in association with each other.

13. The casting facility control system according to claim 12, wherein the actual result data includes at least one of a weight of molten metal received, a temperature of the molten metal received, a time passing after the molten metal is received, a pouring temperature, a fading start time, the material quality information, and test piece identification information.

14. The casting facility control system according to claim 13, further comprising a determination section configured to determine whether or not execution of pouring is allowed, by matching the mold information corresponding to a pouring-target mold against the actual result data.

15. The casting facility control system according to claim 12, further comprising a determination section configured to determine whether or not execution of pouring is allowed, by matching the mold information corresponding to a pouring-target mold against the actual result data.

16. The casting facility control system according to claim 1, further comprising:

an acquisition section configured to acquire actual result data on the pouring machine; and a pouring actual result database configured to store the actual result data acquired by the acquisition section and identification information on the ladle in association with each other.

17. The casting facility control system according to claim 16, wherein the actual result data includes at least one of a weight of molten metal received, a temperature of the molten metal received, a time passing after the molten metal is received, a pouring temperature, a fading start time, material quality information, and test piece identification information.

18. The casting facility control system according to claim 17, further comprising a determination section configured to determine whether or not execution of pouring is allowed, by matching the mold information corresponding to a pouring-target mold against the actual result data.

19. The casting facility control system according to claim 16, further comprising a determination section configured to determine whether or not execution of pouring is allowed, by matching the mold information corresponding to a pouring-target mold against the actual result data.

20. A casting facility control system controlling a casting facility, the casting facility including a molding machine, a mold conveyance device, a melting furnace, a ladle transportation device, and a pouring machine, the molding machine molding a plurality of molds, the mold conveyance device arranging in a line and conveying the plurality of molds molded by the molding machine, the melting furnace melting material to be melted, the ladle transportation device transporting a ladle, the pouring machine pouring molten metal in the ladle transported by the ladle transportation device into the plurality of molds conveyed by the mold conveyance device, the casting facility control system comprising:

a measurement section configured to measure a weight of the molten metal in the ladle transported to the pouring machine by the ladle transportation device; and a decision section configured to determine a weight of molten metal to be next transported to the pouring machine, wherein the weight of the molten metal to be next transported to the pouring machine is equal to a weight obtained by adding up planned weights of molten metal corresponding to the plurality of molds, the plurality of molds being determined depending on a number of flasks by which the poured molten metal can be held calculated based on the weight of the molten metal in the ladle measured by the measurement section and on a planned weight of molten metal associated with each conveyance position.

* * * * *